United States Patent [19]

Stanton

[11] 4,418,656

[45] Dec. 6, 1983

[54] ROTARY MOTION TRANSFORMER

[76] Inventor: Austin N. Stanton, 4240 Briar Creek La., Dallas, Tex. 75214

[21] Appl. No.: 410,966

[22] Filed: Aug. 24, 1982

Related U.S. Application Data

[63] Continuation of Ser. No. 126,893, Mar. 3, 1980, abandoned.

[51] Int. Cl.[3] ..... F02B 75/26

[52] U.S. Cl. ..... 123/58 AM; 92/31; 92/71

[58] Field of Search ..... 92/31, 33, 68, 71, 89; 123/58 R, 58 A, 58 AA, 58 AM

[56] References Cited

U.S. PATENT DOCUMENTS

| | | | |
|---|---|---|---|
| 112,853 | 3/1871 | Ruggles . | |
| 149,059 | 3/1874 | Pierce | 92/31 |
| 205,868 | 7/1878 | Huston . | |
| 657,409 | 9/1900 | Gould . | |
| 696,767 | 4/1902 | Sleeper | 92/89 |
| 766,410 | 8/1904 | Alger | 92/31 |
| 908,916 | 1/1909 | Weinert . | |
| 1,229,009 | 6/1917 | Allison . | |
| 1,276,346 | 8/1918 | Gould . | |
| 1,430,602 | 10/1922 | Sykora . | |
| 1,569,525 | 1/1926 | Owens . | |
| 1,572,068 | 2/1926 | Gould . | |
| 1,728,514 | 9/1929 | Snyder . | |
| 1,761,123 | 6/1930 | Gruver . | |
| 1,799,772 | 4/1931 | Wormley . | |
| 2,177,045 | 10/1939 | Serpas . | |
| 2,388,756 | 11/1945 | Meyers . | |
| 2,473,936 | 6/1949 | Burrough . | |
| 2,896,590 | 7/1959 | Bush . | |
| 3,315,653 | 4/1967 | Chicurel | 92/89 |
| 3,319,612 | 5/1967 | Hamada . | |
| 3,319,615 | 5/1967 | Girerd . | |
| 3,525,216 | 8/1970 | Phillips | 92/31 |
| 3,587,538 | 6/1971 | Poole | 91/197 |
| 3,667,876 | 6/1972 | Boyd . | |
| 3,987,767 | 10/1976 | Buske | 92/89 |
| 4,090,478 | 5/1978 | Trimble | 92/33 |

*Primary Examiner*—Abraham Hershkovitz

*Attorney, Agent, or Firm*—Richards, Harris & Medlock

[57] ABSTRACT

A rotory motion transformer (10) is disclosed which has a cylindrical housing (12) and a rotatable shaft (36). A cam (14) having ascending and descending segments (22–28) forming lobes (30, 32) is included in the housing and axially aligned with the shaft. Equal angular pistons (42–48) are spaced about the shaft (36) and are keyed therewith while remaining axially slidable thereto. The pistons (42–48) have helicoid faces on the surfaces facing the cam (14), the helicoid faces on the pistons mating with the ascending segments of the cam (14). Spring means (52–58) are provided to bias the pistons against the cam (14). When the pistons (42–48) rotate over the cam surface the space between each piston and the cam increases and decreases in volume periodically for each rotation. Intake port means (15, 16) adjacent the lobes (30, 32) provide fluid flow into the rotary transformer (10). Exhaust port means (17, 18) provide for removing fluid from the rotary transformer (10). The spaces between pistons (42–48) and cam (14) are regularly opened and closed to the intake ports (15, 16) and exhaust ports (17, 18) to transfer fluid and accomplish the desired pump air motor action.

21 Claims, 15 Drawing Figures

ROTARY MOTION TRANSFORMER

This is a continuation of application Ser. No. 126,893, filed Mar. 3, 1980 now abandoned.

TECHNICAL FIELD

This invention relates to apparatus for energy conversion involving rotary motion and more particularly to such apparatus which utilizes a working fluid.

BACKGROUND ART

Heretofore numerous machines have been developed for converting the energy of a pressurized fluid into rotary motion as a motor, and likewise for pressurizing fluid by rotary mechanical energy as a pump. The most common configuration for mechanical energy conversion devices of this type is the piston and cylinder structure in which the piston reciprocates in the cylinder while working in conjunction with an interconnected valve train. The well-known devices of this type are the four-cycle OTTO gasoline engine, the diesel engine and the piston-type fluid pump. Despite the wide acceptance of such machines, they still have serious deficiencies in terms of efficiency, cost, size, weight and flexibility.

Another class of mechanical energy conversion machines are those which utilize essentially rotating members rather than reciprocating members. A well-known device of this type is the Wankel internal combustion engine which has a triangular shaped piston which rotates eccentrically in an ellipsoidal cylinder. An earlier development of this general type is a rotary steam engine disclosed in U.S. Pat. No. 205,868 to Huston et al. Additional rotary energy conversion machines are shown in U.S. Pat. No. 1,430,602 to Sykora, U.S. Pat. No. 3,587,538 to Poole and U.S. Pat. No. 3,667,876 to Boyd. Each of these devices, however, suffers inherent mechanical limitations which reduce the practical utility of the device.

Therefore, there exists a need for an improved mechanical energy transformer for converting the energy of a working fluid into rotational mechanical energy and likewise for converting rotational mechanical energy into the energy of a working fluid. Such a rotary motion transformer must operate with a minimum of components, produce a smooth output power from a device of small volume and have a high energy conversion efficiency.

DISCLOSURE OF THE INVENTION

In accordance with the present invention, a rotary transformer is disclosed for pumping a fluid when driven by rotary motion and for producing rotary motion using pressurized fluid as a power source.

A rotary motion transformer is provided which has a housing having a cylindrical interior surface and including a rotatable central shaft. A set of n pistons is included, where n is an even number, each piston having an outer surface slidably mating with the cylindrical interior surface of the housing and an inner surface axially slidable and non-rotatably mating with the central shaft. Annular cams are provided in each end of the housing with each cam having helicoid surfaces facing the pistons. Each cam has surfaces which alternate ascending and descending to form n/2 lobes on each cam. The surface of one cam is the mirror image of the other cam rotated by an angle of 360°/n. Helicoid surfaces are formed on each end of the pistons with the helicoid surfaces mating with the facing, ascending helicoid surfaces on the cams. Intake ports are provided in the region of the lobe peaks and exhaust ports are provided on the cam surfaces approximately midway between the lobes. The ports provide fluid communication to chambers comprising helivoids formed within the rotary motion transformer.

BRIEF DESCRIPTION OF DRAWINGS

A more complete understanding of the invention and its advantages will be apparent from the following Detailed Description taken in conjunction with the accompanying drawings in which.

DETAILED DESCRIPTION

Figure 1:
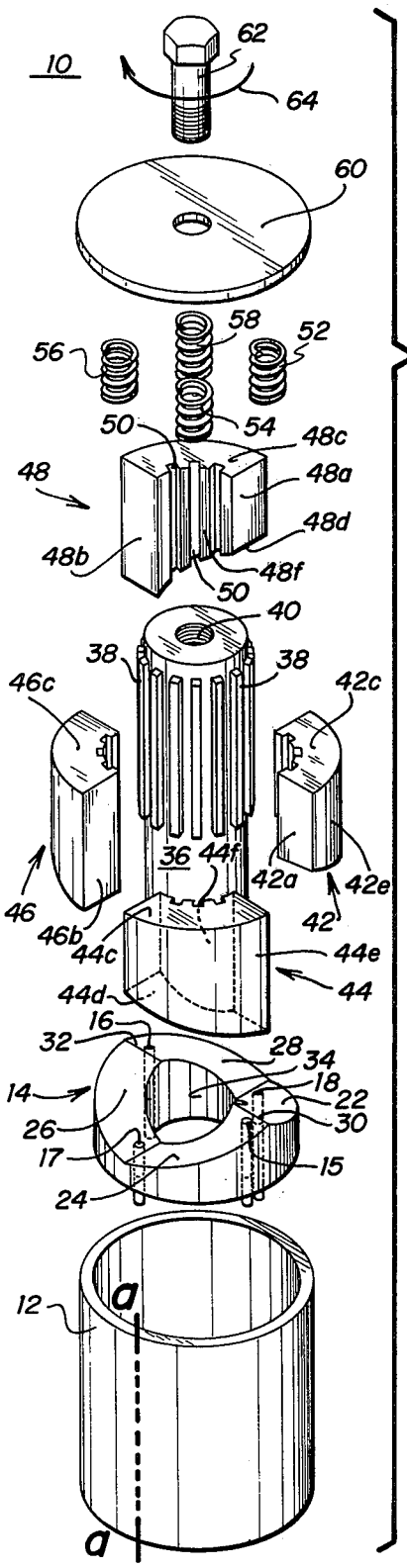
FIG. 1 is an exploded perspective view of a rotary motion transformer in accordance with the present invention.

FIG. 1 illustrates the rotary transformer of the present invention embodied as a single ended pump/motor. The rotary transformer, designated generally as 10, is shown in an exploded view to better illustrate the various components and their relationships.

A housing 12 encloses the operating components of the engine and has a cylindrical interior volume.

A cam 14 has a generally cylindrical shape and is sized to fit within housing 12. Cam 14 is provided with intake ports 15 and 16 and exhaust ports 17 and 18 with both the intake and exhaust ports aligned parallel with the axis of cam 14. The surface of cam 14 is provided with four cam segments 22–28. In terms of clockwise rotation cam segments 22 and 26 have ascending surfaces while the cam segments 24 and 28 have descending surfaces. The combination of the alternating ascending and descending surfaces produces lobes 30 and 32 spaced on opposite sides of the cam 14. Each of the cam surfaces 22–28 has a helicoid shape with the surfaces essentially normal to the axis of cam 14 at all points. Cam segments 22–28 form a continuous annular surface about an axial hole 34 passing through cam 14. Intake port 15 passes through cam segment 24 and opens adjacent lobe 30 while intake port 16 passes through cam surface 28 and opens adjacent lobe 32. Exhaust port 17 passes through cam surface 26 and opens at the lower, leading edge thereof. Likewise, exhaust port 18 passes through cam surface 22 and opens at the lower, leading edge thereof.

The rotary motion of transformer 10 is transmitted through a shaft 36 which is axially aligned within the housing 12 while passing through hole 34 in cam 14. Shaft 36 is provided with longitudinal splines 38 which extend over a substantial length of the shaft segment within the housing 12. Splines 38 are spaced uniformly about shaft 36. The top of shaft 36 has a threaded, axial hole 40 for receiving a bolt 62 therein.

The rotary transformer 10 includes a set of four pistons 42–48 which are spaced uniformly about shaft 36. The pistons are similarly shaped and will be described in reference to pistons 44 and 48. Piston has a leading surface 48*a* and a trailing surface 48*b*, these surfaces being planar and orthogonal to each other. The upper surface 48*c* is also planar while being orthogonal to both the leading and trailing surfaces. The lower surface of the piston 48 is a helicoid face 48*d* which is shaped and dimensioned so that it mates with each of the ascending cam segments 22 and 26. The outer surface, 44*e* of piston 44, is cylindrically shaped with a one-quarter section and has a curvature that mates with the interior surface of housing 12. The interior surface, 48*f* of piston 48, is also cylindrical and includes spline slots 50 which receive the splines 38 on the shaft 36.

Pistons 42–48 are forced downward respectively by four springs 52–58. Each of the springs is compressed between a head plate 60 and the upper surface of one of the pistons. Plate 60 is secured to shaft 36 by the bolt 62 which is threadedly engaged thereto through hole 40. The plate 60 thus turns in rotation with the shaft 36 and the pistons 42–48 relative to housing 12 while maintaining a pressure seal with respect to the housing. The springs are compressed so as to bias the pistons against the cam 14 with sufficient force to form an effective pressure seal. Thus, each piston is maintained in constant contact with the surface of cam 14 during the rotation of the pistons with the shaft.

Pistons 42–48 each have an angular dimension of 90° such that the four pistons together completely encircle shaft 36. The adjacent leading and trailing surfaces of the pistons are in planar contact with each other. As previously described the lower surface of each piston has a helicoid face disposed opposite the cam 14 and each piston is constantly in contact with the cam. The pistons are keyed to the shaft 36 and rotate with this shaft while contacting the cam 14. Thus, as the pistons rotate with shaft 36 they also reciprocate along lines parallel to the axis of shaft 36. This reciprocating movement causes the springs 52–58 to be sequentially compressed as the corresponding piston rises and reduced in compression when the spring forces the piston down as the piston descends from the lobes to the lower portions on the cam 14. As shown in FIG. 1, the pistons rotate about the shaft 36 in the direction of the arrow 64.

Figure 2:
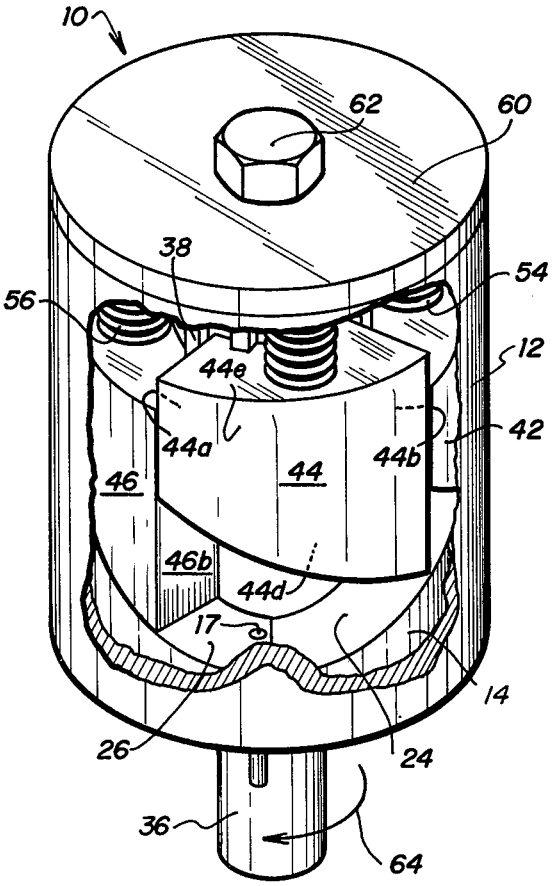
FIG. 2 is a cut-away perspective view of the rotary motion transformer illustrated in FIG. 1.

The rotary motion transformer 10 of the present invention is illustrated in an assembled form in FIG. 2. Each of the pistons 42–48 form sliding and sealing engagements with the contiguous components. For example, piston 44 forms a seal along the line of contact of the helicoid face 44*d* with the cam segment 24. The leading surface 44*a* forms a pressure seal with the trailing surface 46*b* of the immediately preceding piston 46. The interior surface 44*f* is keyed to the shaft 36 while at the same time forming a seal with respect to the shaft. The trailing surface 44*b* is slidably engaged to form a pressure seal with the succeeding piston leading surface 42*a*. Likewise, the outer surface 44*e* is in contact with the cylindrical interior surface of the housing 12 and is engaged to form a pressure seal therewith. Thus, each piston has a pressure seal in relation to each adjoining sliding component.

FIGS. 3*a*, 3*b*, 3*c*, and 3*d* are a schematic illustration of the operation of the pistons and cam surfaces of rotary motion transformer 10. For purposes of illustration and greater clarity the pistons and cam in FIGS. 3*a*, 3*b*, 3*c*, and 3*d* are shown as they would appear if the housing 10 were cut along the line a—a and the components rolled flat. The cam 14 remains stationary and rotary motion is shown by movement of the pistons 42–48 in the direction of the arrow 64.

Operation of the rotary transformer 10 of the present invention is now described in reference to FIGS. 1, 2 and 3*a*–3*d*. The operation will be described for use of the rotary transformer 10 as a fluid pump. A source of rotary drive power (not shown) is connected to shaft 36 to provide the necessary motive power for pumping the fluid. As the shaft 36 is turned, the pistons 42–48, which are keyed to the shaft, are rotated at the same rate while tracking the surface of cam 14. The source for the fluid being pumped is connected to input ports 15 and 16 while the exhaust line for the fluid is connected to ports 17 and 18.

Figure 3A:
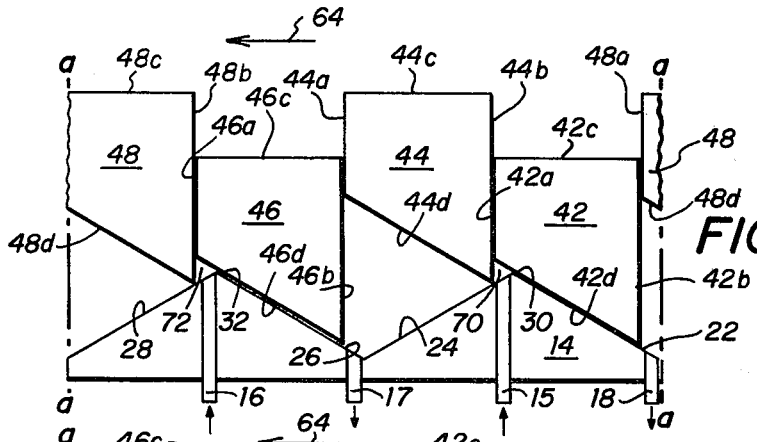
FIG. 3*a* is a schematic elevation view showing the pistons and cam of the rotary motion transformer illustrated in FIGS. 1 and 2 where the transformer housing has been cut along line a—a and rolled flat to linearly show the operation of the rotary pistons.

As shown in FIG. 3*a*, the leading edges of pistons 42 and 46 have slightly passed the intake ports 15 and 16. As the pistons pass these ports, helivoids 70 and 72 are formed and are respectively in fluid communication with input ports 15 and 16. The term helivoid is defined herein to be a chamber having one or more helicoid bounding surfaces. Helivoid 70 is enclosed by the trailing surface 44*b* of piston 44, the helicold face 42*d* of piston 42, cam segment 24, shaft 36, and the interior surface of the housing 12. When the leading surface 42*a* is over lobe 30, the helivoid 70 has essentially zero volume, but as the piston 42 progresses forward, the volume of helivoid 70 increases. Helivoid 72 is likewise formed between pistons 46 and 48 and also progressively increases in volume as the shaft 36 is rotated.

Figure 3B:
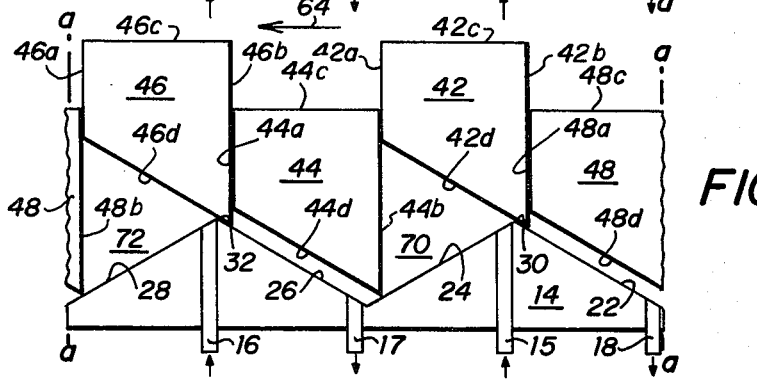
FIG. 3*b* is an illustration as shown in FIG. 3*a* but in which the pistons have progressed along the cam surface.
Figure 3C:
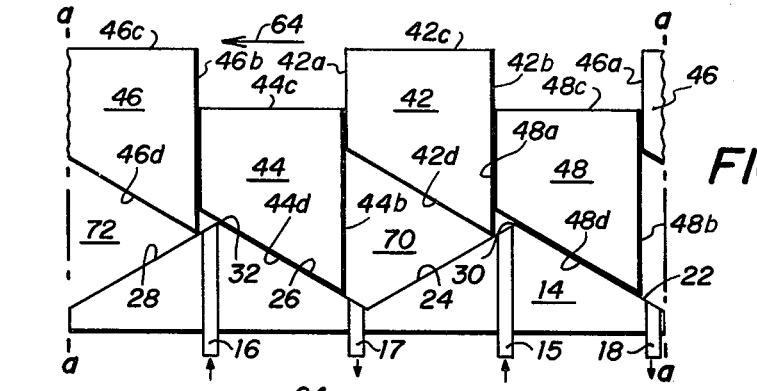
FIG. 3*c* is an illustration as shown in FIG. 3*a*, but in which the pistons have progressed further along the cam surface.

In FIG. 3*b* helivoids 70 and 72 are shown as they approach their maximum volume. As helivoid 70 is increasing in volume it draws the fluid in through port 15 to occupy the increasing volume. Helivoid 72 likewise draws fluid in through intake port 16. When the trailing surface 42*b* of piston 42 reaches the peak of lobe 30, helivoid 70 has reached its maximum volume and no longer draws fluid in through intake port 15. When piston 42 progresses slightly beyond the peak of lobe 30 it seals off intake port 15 from helivoid 70. At the same time helivoid 70 is opened to exhaust port 17. This is illustrated in FIG. 3*c*. Similarly, piston 46 seals off heiivoid 72 from intake port 16 and opens it to exhaust port 18.

Figure 3D:
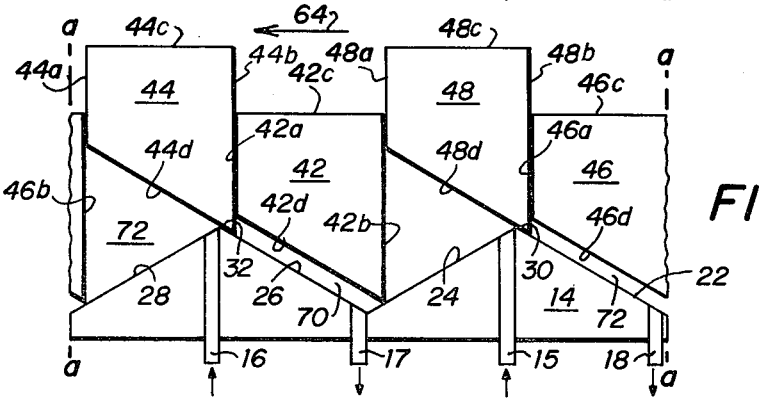
FIG. 3*d* is an illustration as shown in FIG. 3*a*, but in which the pistons have progressed still further along the cam surface.

As piston 42 moves along cam 14 it follows the cam segment 24 and progressively decreases the volume of helivoid 70 as shown in FIG. 3*d*. The decrease in volume applies pressure to the fluid in the helivoid which forces the fluid out through exhaust port 17. As piston 42 advances still further the volume of helivoid 70 becomes less until the helicoid face 42*d* of piston 42 mates with cam segment 26 at which point the volume of helivoid 70 is essentially zero and all of the fluid has been forced out of the helivoid. Likewise, the fluid in helivoid 72 is driven out through exhaust port 18. When the piston 42 progresses a slight distance forward past alignment with the cam segment 26 the exhaust port 17 is bypassed and is opened to the succeeding helivoid. The process described above is repeated for each piston so that fluid which is input through port 15 is transported for one-quarter revolution in the fluid transformer 10 and output through exhaust port 17. The fluid input at intake port 16 is exhausted at exhaust port 18. Thus, for the embodiment described, there are eight pump strokes for each revolution of the shaft 36.

The rotary transformer 10 can be connected as shown to function as a vacuum pump. As a vacuum pump, the rotary transformer illustrated is particularly advantageous since the volume of the chamber is reduced to essentially zero so that a very low vacuum pressure can be produced. Likewise, the rotary transformer can be used as an air compressor to produce high pressure levels.

The rotary transformer 10, as shown in FIGS. 1, 2 and 3*a*–3*d*, can also be utilized as a motor which is driven by a pressurized fluid to produce rotary motion. When used in this manner a pressurized fluid from a source (not shown) is connected to the input ports 15 and 16 while the exhaust ports 17 and 18 are connected to a low pressure sink. In reference to FIG. 3*a*, as the pressurized fluid is input through port 15 the helivoid 70 is pressurized. The pressure of the fluid is exerted uniformly on all surfaces of the helivoid 70. However, in terms of rotary force, the piston 44 has a vertical area exposed which is approximately double that of the vertical projection of piston 42. Therefore, there will be a net force against piston 44 causing it to move in the direction of arrow 64 thus providing rotation of shaft 36. The vertical projection of lower surface 44*d* of piston 44 is exposed to low pressure through the exhaust port 17 and therefore produces relatively little back torque.

For approximately one-quarter of a revolution, helivoid 70 remains open to the input port 15. Therefore, the pressurized fluid continues to drive piston 44 ahead. In reference to FIG. 3*b*, as the trailing edge of the helicoid face 42*d* of piston 42 crosses the peak of lobe 30, the intake port 15 is sealed off from the helivoid 70. At the same time that the intake port 15 is closed to helivoid 70, the exhaust port 17 is opened to helivoid 70. This is as shown in FIG. 3*c*. The exhaust port 17 is at a low pressure level, therefore, the fluid in helivoid 70 can easily be exhausted. As the piston 42 continues to advance, the fluid will be steadily exhausted from helivoid 70 out through exhaust port 17. When piston 42 reaches the point of aligning with cam segment 26 the volume of helivoid 72 is reduced to essentially zero and all of the fluid is exhausted.

In the same manner as described above, fluid which is input through intake port 16 into helivoid 72 drives piston 48 forward until that fluid is likewise output through exhaust port 18.

Note that in operation as a pressure driven motor, the fluid transformer 10 of the present invention has a near constant input rate of pressurized fluid so that there is a steady and continuous torque produced by the shaft 36. Working fluid power sources which can be utilized to drive the rotary transformer 10 as a motor include, but are not limited to, steam, compressed air, pressurized hydraulic fluid, and a vacuum source connected to the exhaust ports.

Figure 4:
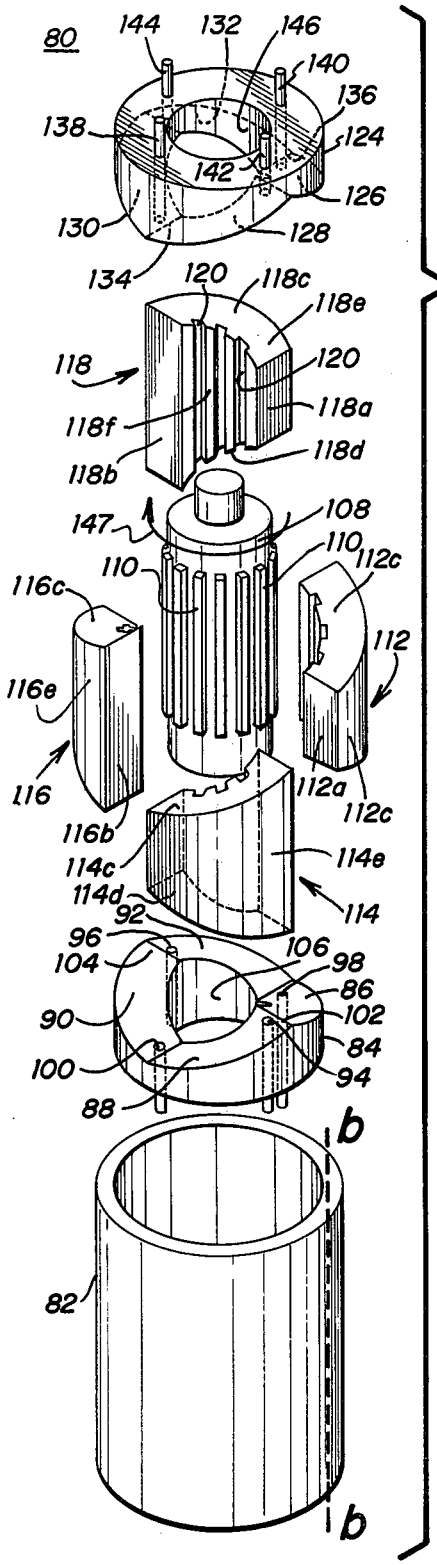
FIG. 4 is an exploded perspective view of a double-ended rotary motion transformer of the present invention.

The preferred embodiment of the rotary transformer of the present invention is illustrated in FIG. 4. This transformer is essentially a double-ended version of the transformer illustrated in FIGS. 1 and 2. Rotary transformer 80 is contained within a housing 82 which has a cylindrical inner surface.

A lower cam 84 is circular and sized to fit within the housing 82. The surface of cam 84 consists of four segments 86–92 which have alternating ascending and descending slopes. The cam segments 86–92 are fitted with intake ports 94 and 96 together with exhaust ports 98 and 100. The ascending and descending cam segments form oppositely spaced lobes 102 and 104. An axial hole 106 passes centrally through the cam 84.

A shaft 108 is sized to pass through the hole 106 in cam 84 so as to be centrally located within the housing 82 and rotatable relative thereto. A set of splines 110 are aligned longitudinally along the surface of shaft 108.

The working members within the rotary transformer 80 are four pistons 112–118. The pistons have similar shapes and are spaced uniformly about the shaft 108 while being enclosed within housing 82. As illustrated by piston 118, there is a leading surface 118*a* and a trailing surface 118*b*, the surfaces being planar, orthogonal and parallel to the axis of shaft 108. Piston 118 has a helicoid upper face 118*c*, as well as a helicoid lower face 118*d*. The helicoid lower face 114*d* of piston 114 is a better illustration of this surface. From the leading surface 118*a* the upper and lower helicoid faces slope away from each other until they intersect the trailing surface 118*b*. The axial length of the leading surface 118*a* is, therefore, less than that of the trailing surface 118*b*. The outer surface 118*e*, better shown as 114*e* of piston 114, is a cylindrical quarter section which mates with the interior surface of the housing 82. Facing the shaft 108, the piston 118 has an interior surface 118*f* which is generally cylindrical in shape but includes longitudinal spline slots 120 for receiving splines 110 on shaft 106.

The rotary transformer 80 further includes an upper cam 124 also sized for inclusion within the housing 82. Cam 124 includes alternating ascending and descending cam segments 126–132 which form lobes 134 and 136. Cam segments 126–132 are fitted with intake ports 138 and 140 together with exhaust ports 142 and 144. One port passes through the surface of each cam segment. Cam 124 also includes an axial hole 146 for receiving shaft 108. The surface of cam 124 is the mirror image of the surface of cam 84 offset by 90°.

The upper surface of each of the pistons 112–118 has a helicoid face which mates with both ascending segments 128 and 132 of the upper cam 124 viewed in respect to arrow 147. Likewise, the helicoid lower face of each of the pistons 112–118 mates with both of the ascending segments 86 and 90 of the lower cam 82.

Figure 5:
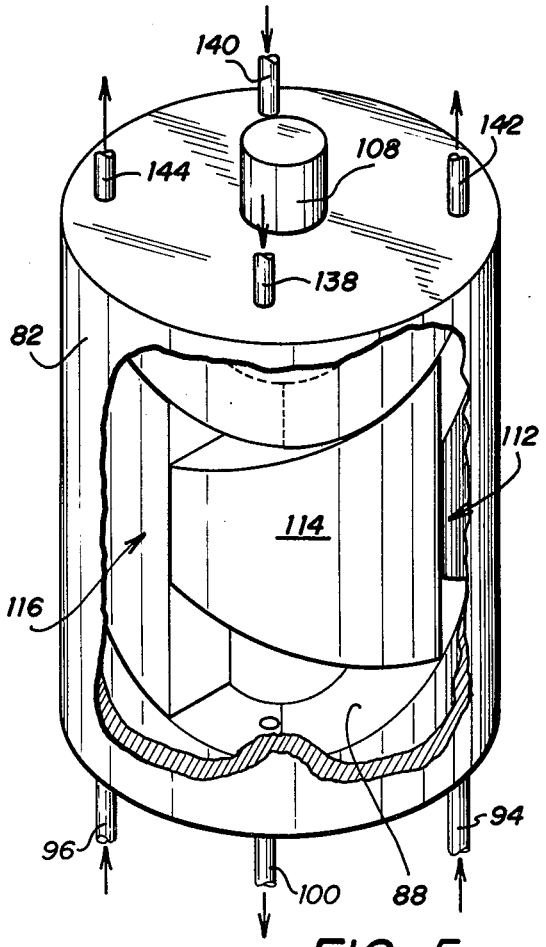
FIG. 5 is a cut-away perspective view of the double-ended rotary motion transformer illustrated in FIG. 4.

The rotary transformer 80 is illustrated as assembled into an operating unit in FIG. 5. The pistons 112–118 are set immediately against the shaft 108 so that the splines 110 engage the spline slots 120. In this manner the pistons are keyed to the shaft so that the pistons may slide axially but are fixed rotatably in respect to the shaft. The cams 84 and 124 are spaced axially apart so that the pistons 120–126 are positioned therebetween. Each cam is simultaneously in contact with the opposing faces of each piston.

The upper and lower intake ports 94, 96, 138 and 140 are located immediately adjacent the upper extensions of the lobes of cams 84 and 124 respectively. The intake ports pass through the cams to provide fluid communication into the rotary transformer 80. The upper and lower exhaust ports 98, 100, 142 and 144 are located adjacent the respective cam surface approximately midway between the lobes within the cam valleys. The exhaust ports provide fluid communication for removing fluids from the rotary transformer 80. The rotary transformer is designed for rotation of the pistons in the direction of arrow 147.

Figure 6A:
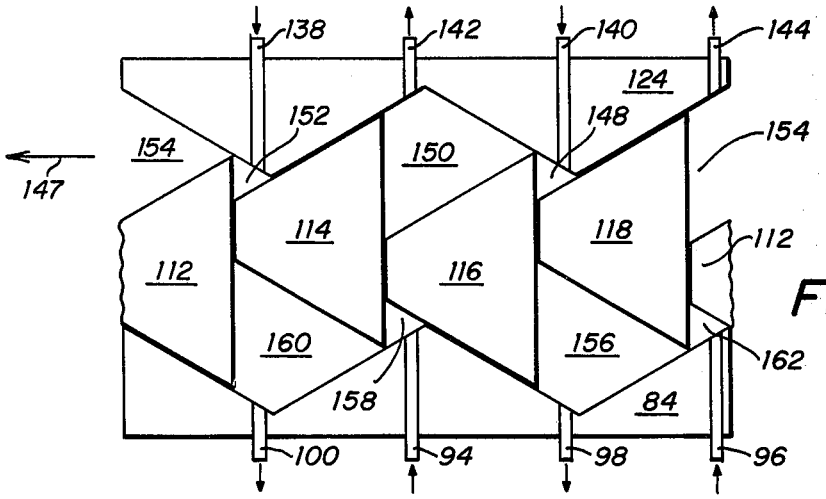
FIG. 6*a* is a schematic elevation view showing the pistons and cam of the double ended rotary motion transformer illustrated in FIGS. 4 and 5 wherein the transformer housing has been cut along line b—b and rolled flat to linearly show the operation of the rotary pistons.
Figure 6B:
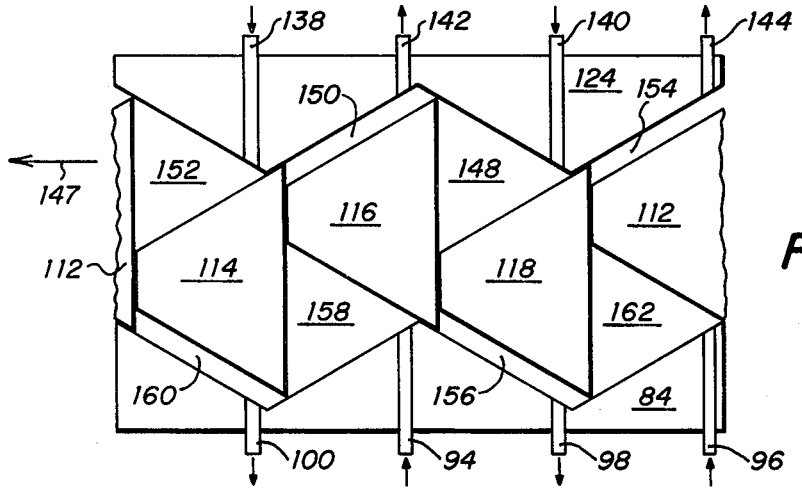
FIG. 6*b* is an illustration as shown in FIG. 6*a*, but in which the pistons have progressed along the cam surface.
Figure 6C:
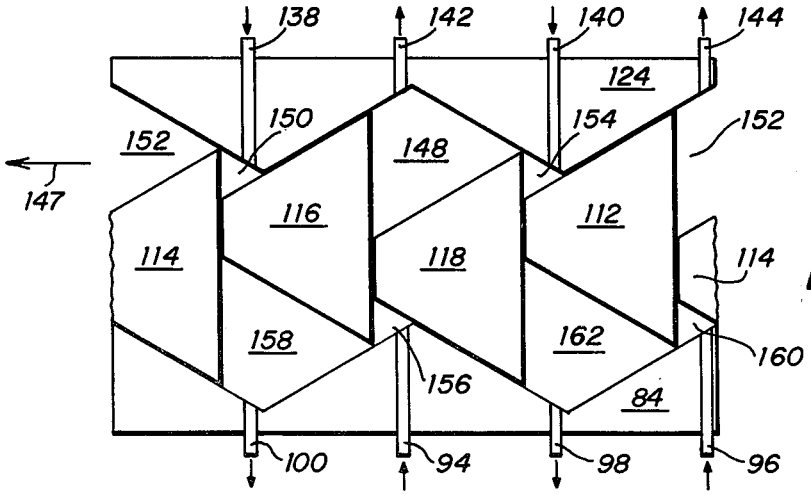
FIG. 6*c* is an illustration as shown in FIG. 6*a*, but in which the pistons have progressed further along the cam surface.

Rotary transformer 80 can function as both a pump and as a fluid driven motor in the configuration shown. Operation of the rotary transformer 80 as a pump is described in reference to FIGS. 4, 5 and 6*a–6c*. FIGS. 6*a–6c* are illustrations in the same form as FIGS. 3*a–3d*, wherein for purposes of greater clarity, the rotary transformer is shown as if the housing were split along the line b—b and rolled flat with the pistons and cams likewise rolled flat but maintained with the same relative orientations.

In operation as a pump the rotary transformer 80 is driven by a power source (not shown) which is connected to the shaft 108 to produce rotation in the direction of the arrow 147. The pistons 112–118 are keyed to the shaft 108 and thus are caused to rotate within the housing 82 while maintaining contact with both the lower cam 84 and upper cam 124. As illustrated in FIG. 6*a* the pistons move in the direction of arrow 147 while the cams remain stationary. In FIG. 6*a* the pistons and cams form upper helivoids 148–154 and lower helivoids 156–162. As the pistons advance, helivoids 148, 152, 158 and 162 increase in volume while being open to intake ports 140, 138, 94 and 96 respectively. Thus, as the volume of these helivoids increases, fluid is drawn into the helivoids through the fluid intake ports.

Helivoids 150, 154, 156 and 160 decrease in volume as the pistons 112–118 advance in the direction of arrow 147. These helivoids are open to exhaust ports 142, 144, 98 and 100 respectively. As these helivoids decrease in volume the fluid therein is driven out through the adjacent exhaust ports.

The progression of the pistons between the cams is illustrated in FIG. 6*b*. Helivoids 148, 152, 158 and 162 have each increased in volume while helivoids 150, 154, 156 and 160 have decreased in volume. Thus, fluid is being drawn in through the intake ports and driven out through the exhaust ports.

As the pistons progress even further forward as shown by the arrow 147, they each reach a point wherein one face is flush with one of the cam surfaces while the other is in contact with the opposing face only along a single line of action. At this point, the volumes of the exhausting helivoids are essentially zero while that of the receiving helivoids are at a maximum. As the pistons pass this point the chambers reverse function with those that had been exhausting fluid closing to the exhaust ports and opening to the intake ports to draw fluid inward during the expansion of the helivoid. Likewise, those helivoids which were drawing fluid inward close to the intake port and open to the exhaust port. This condition is shown in FIG. 6*c*. Helivoids 148, 152, 162 and 158 are now exhausting fluid through exhaust ports 142, 144, 98 and 100, respectively. Helivoids 150, 154, 156 and 160 have switched from exhausting fluid to drawing fluid inward through ports 138, 140, 94 and 96, respectively.

The intake and exhaust process described above is repeated twice each cycle for each piston. Thus, the present invention as embodied in FIG. 4 produces the same number of pump strokes (16) per revolution as a conventional recirocating piston pump having 16 cylinders.

The rotary transformer 80 can also function as a pressurized fluid driven motor in the embodiment shown. For such operation the pressurized fluid is supplied to the intake ports and a low pressure drain is connected to receive the spent fluid through the exhaust ports. Operation as a motor is the same as that described for the motor configuration of the embodiment shown in FIG. 1 but with the operation being carried out at both ends of the pistons in action with the two cam surfaces.

The rotary transformer 80 can further be utilized as a vacuum pump when a power source (not shown) is connected to drive the shaft 108. As used in this configuration the input ports 140, 138, 94 and 96 are connected to the enclosure which is to be evacuated. The exhaust ports are opened to the atmosphere. As the leading edge of each piston reaches an input port, the volume of the helivoid between the piston and contiguous cam surface is essentially zero. As the piston passes the input port the volume of the adjacent helivoid expands thus drawing in gas from the enclosure. The gas thus drawn in is dumped to the atmosphere through the exhaust ports when the volume of the helivoid again reduces to approximately zero. Multiple stage pumping action can be achieved to produce a greater vacuum by connecting the upper and lower chambers of the rotary transformer 80 in series. In such a configuration the input ports 138 and 140 are connected to the evacuation enclosure while the exhaust ports 142 and 144 are connected to the lower intake ports 94 and 96 while the exhaust ports 98 and 100 remain open to the atmosphere.

A vacuum pump with a still greater number of stages can be implemented by serial connection of each of the chambers adjacent the upper cam in serial connection with each of the chambers of the lower cam. This would be accomplished by connecting port 138 to the evacuation enclosure while interconnecting port 144 to 140, 142 to 94 and 100 to 96. A pump of this configuration would have a lesser evacuation rate but could produce a greater pressure differential due to the greater number of stages.

In regard to implementation of the rotary transformer 80 as a motor driven by pressurized fluid, the interconnection of the input and output ports to the source of pressurized fluid can be changed to produce different power-driven shaft results. If the pressurized fluid is simultaneously introduced in parallel to each of the input ports at a given rate, the rotary transformer will turn at a relatively slow rate but with a substantial amount of torque. If, on the other hand, each of the input and output ports are connected in series and the same fluid flow at the given rate is input into a first of the chambers, the shaft of the rotary transformer 80 will turn at a rate which is eight times that produced as compared to a parallel input. The torque produced by the engine would, of course, be proportionately less. Further, various combinations of serial and parallel connections could be implemented between the various input and output ports to produce different ratios of speed and torque. A transmission is thereby implemented in an assembly which is operated by only opening and closing various valves (not shown).

Figure 7:
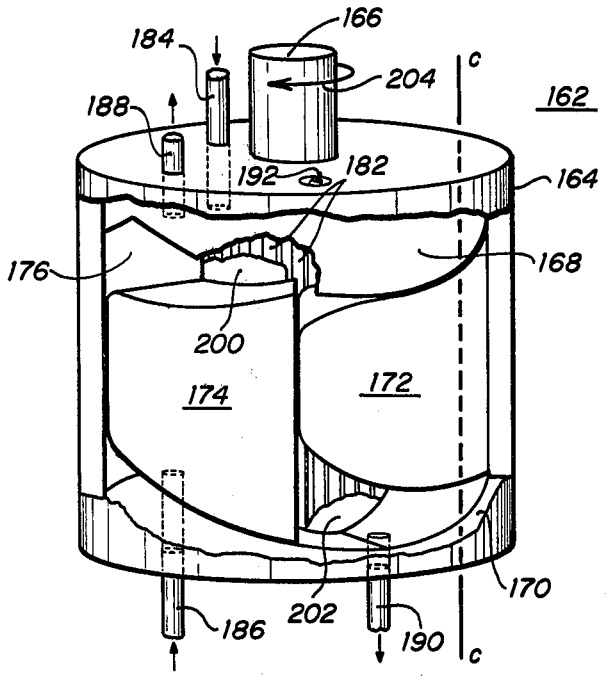
FIG. 7 is a cut-away perspective view of an internal combustion engine embodiment of the present invention.
Figure 8:
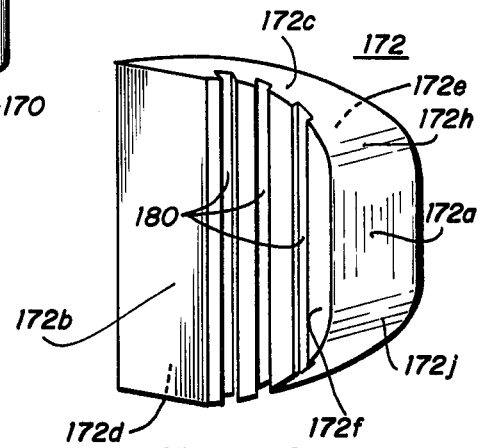
FIG. 8 is a perspective view of a piston shown in FIG. 7.
Figure 9:
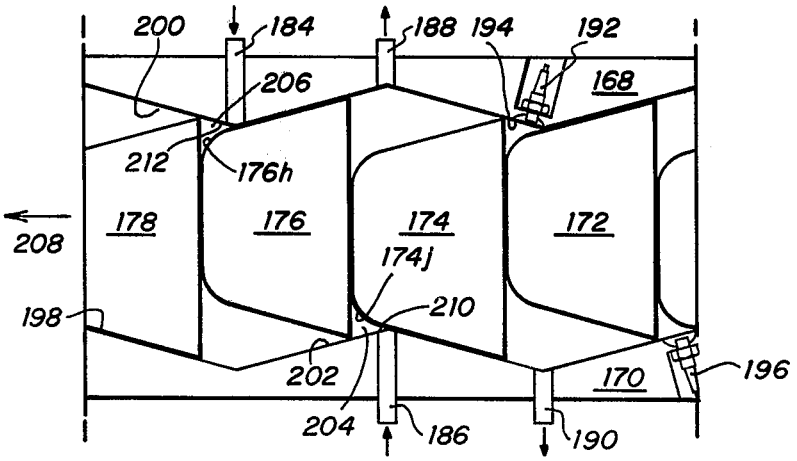
FIG. 9 is a schematic elevation view of the internal combustion engine illustrated in FIG. 7 wherein the housing has been cut along line c—c and rolled flat to give a linear illustration of the operation of the rotary pistons.

A further embodiment of the present invention is illustrated in FIGS. 7–9 wherein a rotary transformer 162 is configured to be an internal combustion engine using a four cycle system. The rotary transformer 162 shown in FIG. 7 is similar to the rotary transformer 80 shown in FIG. 4. The differences are in the shape of the pistons, the lesser number of input and output ports and the addition of spark plugs.

The rotary transformer 162 includes a housing 164 with a cylindrical inner surface and a central shaft 166. Within the housing 164 there are upper and lower cams 168 and 170 respectively which correspond to cams 124 and 84 illustrated in FIGS. 4 and 5. Disposed between the cams 168 and 170 are four equal-angular pistons 172–178 which are of identical shape. Piston 172 is illustrated in greater detail in FIG. 8.

Piston 172 has a planar leading surface **172*a* and a planar trailing surface 172*b*. The leading and trailing surfaces of the piston are orthogonal and are parallel to the axis of the shaft 166. The upper surface 172*c* has a helicoid shape which essentially mates with the ascending segments of the cam 168. A lower surface 172*d* is similarly shaped to mate with the ascending segments of cam 170. The outer surface 172*e* is cylindrically shaped to mate with the interior surface of the housing 164. Inner surface 172*f* is cylindrical to mate with the shaft 166, but also includes spline slots 180 which match the splines 182 on shaft 166. Piston 172 has a transition surface 172*h* which blends the upper surface 172*c* into the leading surface 172*a*. It is this transition section which differs piston 172 from the pistons 112–118 illustrated in FIG. 4. A similar transition section 172*j* connects between the leading surface 172*a* and the lower surface 172*d*. Each of the these transition sections lessens the volume of the piston 172** so that the helivoids formed by the piston are not reduced to a near zero volume during the mating of the piston with the corresponding cam segment. The size of the transition sections essentially determines the minimum volume of the helivoids during rotation of the pistons.

Returning to FIG. 7, the rotary transformer 162 has an upper intake port 184 and a lower intake port 186, both of which are connected to a device such, as for example, a carburetor which generates a fuel/air mixture for combustion within the rotary transformer. The caburation device is not shown. An upper exhaust port 188 and a lower exhaust port 190 provide a pathway through the housing 164 to exhaust gases generated within the rotary transformer 162.

FIG. 9 is a schematic illustration of the piston and cam arrangement of the rotary transformer 162 shown in FIG. 7 in the form wherein the transformer is opened along line c—c and rolled flat for illustration purposes. The intake and exhaust ports are shown in FIG. 9 as well.

Rotary transformer 162 further includes an upper spark plug 192 which is mounted adjacent a lobe 194. A lower spark plug 196 is located adjacent a lobe 198. The spark plugs are located just past the lobe peaks. The spark plugs are provided with a timed spark for igniting the compressed fuel/air mixture in the adjacent helivoids.

The rotary transformer 162 further includes protective shields 200 and 202 which are located adjacent the inner edges of the cams 168 and 170 but spaced outward from the shaft 166. These shields serve to protect the shaft 166 and splines on the shaft from the compression and heat caused by combustion of the fuel products in the compression helivoids.

Operation of the internal combustion engine rotary transformer 162 is described in reference to FIGS. 7–9. The pistons 172–178 rotate within the housing 164 while simultaneously reciprocating longitudinally. The pistons are keyed to the rotatably shaft 166 so that they are free to slide longitudinally. Each piston simultaneously contacts the upper cam 168 and the lower cam 170 and is quided in its longitudinal motion by these cams as it rotates within the housing 164. This engine utilizes the conventional OTTO four cycle technique.

The intake strokes begin as each of the pistons approaches an intake port, either 184 or 186. For example, as shown in FIG. 9, pistons 174 and 176 are beginning the intake stroke as they approach lobes 210 and 212, respectively. In the position shown for piston 174 the transition edge **174*j* creates a helivoid 204 having a predefined volume. Likewise, the transition edge 176*h* of piston 176 forms a helivoid 206. As the pistons 174 and 176 advance in the direction of arrow 208 the helivoids 204 and 206 increase in volume until the trailing surface of each of the pistons is aligned with lobes 210 and 212, respectively. At this point the helivoids 204 and 206 have reached the maximum volume. As the pistons 174 and 176 advance slightly, the intake ports 184 and 186 are closed off to the helivoids 204 and 206**.

In the next one-quarter revolution the pistons compress the fuel/air mixture to the minimum volume defined by the edge transitions **174*j* and 176*h*. When the minimum volume is reached, the pistons are aligned over the section of the cam surfaces immediately preceding the spark plugs 192 and 196. When the pistons progress slightly beyond the lobe peaks, the spark plugs ignite the fuel/air mixture which then substantially increases the pressure in the helivoids. The increase in pressure drives the pistons forward which causes the enclosed helivoids 204 and 206 to expand in volume during the next one-quarter revolution which constitutes the power stroke. When the helivoids have reached the maximum volume, this being at the end of the power stroke, they are then opened to the exhaust ports 188 and 190. During the next one-quarter revolution the helivoids are reduced in volume which causes the burned fuel and air mixture to be exhausted through the exhaust ports. The gas is exhausted to the extent of the minimum volume of the helivoids 204 and 206. At the end of the exhaust stroke the pistons 174 and 176** have returned to the original position as shown in FIG. 9. The remaining pistons 172 and 178 function in the same manner as described for pistons 174 and 176.

Each spark plug fires four times for each revolution of shaft 166, once for each piston on their respective ends. Thus, the internal combustion engine rotary transformer 162 of the present invention has eight power strokes for each revolution. This number of power strokes per revolution is equivalent to a 16 cylinder conventional reciprocating four cycle gasoline engine. This large number of power strokes per revolution maintains a steady torque on the shaft 166. Further, since the helivoids expand when the fuel is ignited and uniformly increase in volume as the pressure becomes less the force applied to the pistons to cause revolution is maintained at a substantially constant magnitude. Thus, the combination of numerous power strokes and a uniform force during each power stroke makes the engine operate an extremely smooth and continuous power output.

Only a slight modification to the embodiment shown in FIG. 7 is necessary to convert the gasoline engine therein into a diesel engine. The only substitution necessary to the replacement of the spark plugs with fuel injectors. A diesel engine requires a substantially greater compression ratio than a gasoline engine since the heat of compression causes the fuel ignition. In the present invention the compression ratio is determined by the size and shape of the transition edges h and j of each piston. Therefore, with these edges shaped for a high compression ratio and fuel injectors installed in place of the spark plugs, the rotary transformer 162 of FIG. 7 would function essentially as described for the gasoline engine but with fuel injection in place of spark ignition.

Figure 10:
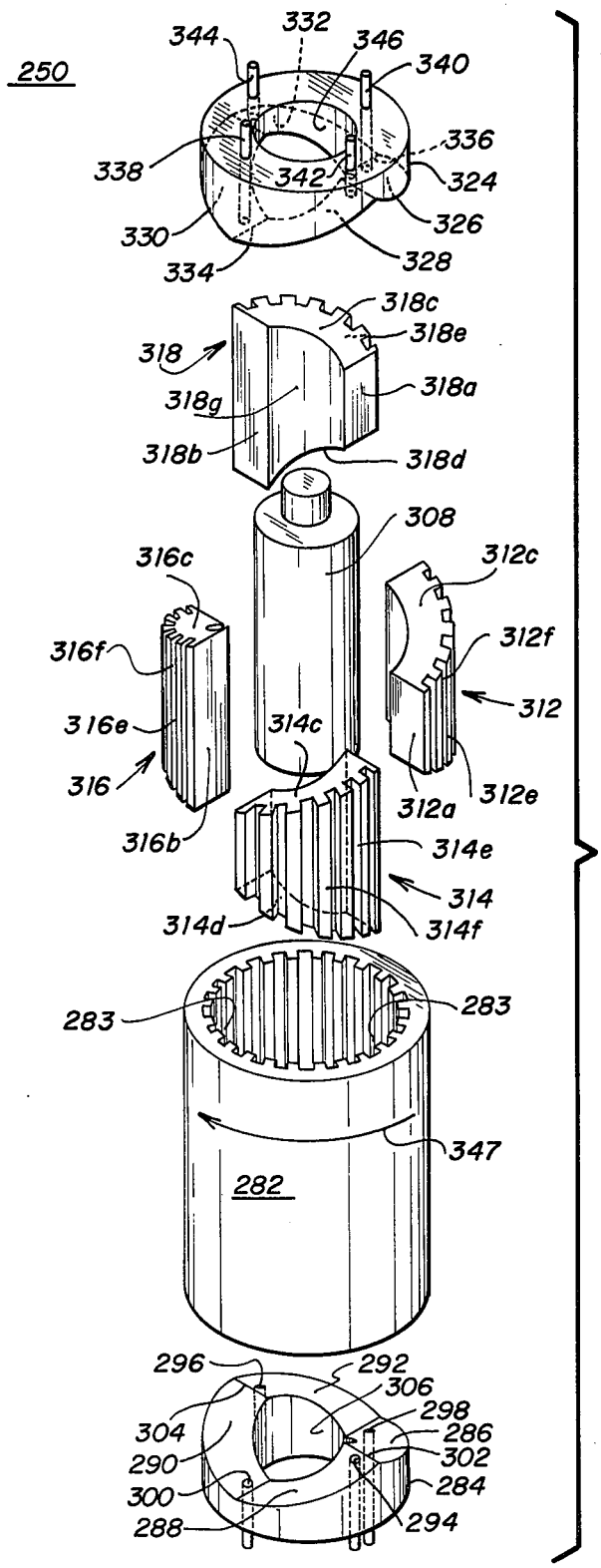
FIG. 10 is an alternative embodiment of a rotary motion transformer in accordance with the present invention wherein the interior surface of the housing is provided with splines which mate with splines on the outer surfaces of the pistons.

A further embodiment of the rotary transformer of the present invention is illustrated in FIG. 10. This transformer is essentially a modified version of the transformer illustrated in FIGS. 4 and 5 wherein the splines 110 and corresponding slots are deleted. A set of splines are added to the exterior surfaces of the pistons and mate with corresponding slots on the interior surface of the housing so that the housing moves in rotation with the pistons. Rotary transformer 250 includes housing 282 which has a cylindrical inner surface provided with a plurality of longitudinal slots 283.

A lower cam 284 is circular and sized to fit within the housing 282. The surface of cam 284 consists of four segments 286–292 which have alternating ascending and descending slopes. The cam segments 286–292 are fitted with intake ports 294 and 296 together with exhaust ports 298 and 300. The ascending and descending cam segments form oppositely spaced lobes 302 and 304. An axial hole 306 passes centrally through the cam 284.

A shaft 308 is sized to pass through the hole 306 in cam 284 so as to be centrally located within the housing 282.

The working members within the rotary transformer 250 are pistons 312, 314, 316 and 318. The pistons have similar shapes and are spaced uniformly about the shaft 308 while being enclosed within housing 282. As illustrated by piston 318, there is a leading surface **318*a* and a trailing surface 318*b*, the surfaces being planar, orthogonal and parallel to the axis of shaft 308. Piston 318 has a helicoid upper face 318*c*, as well as a helicoid lower face 318*d*. The helicoid lower face 314*d* of piston 314 is a better illustration of this surface. From the leading surface 318*a* the upper and lower helicoid faces slope away from each other until they intersect the trailing surface 318*b*. The axial length of the leading surface 318*a* is, therefore, less than that of the trailing surface 318*b*. The outer surface 318*e*, better shown as 314*e* of piston 314, is a cylindrical quarter section having splines 314*f* which mate with the slots 238 on the inner surface of housing 282. Facing the shaft 308, the piston 318 has an interior surface 318*g*** which is generally cylindrical in shape.

The rotary transformer 250 further includes an upper cam 324 also sized for inclusion within the housing 282. Cam 324 includes internating ascending and descending cam segments 326–332 which form lobes 334 and 336. Cam segments 326–332 are fitted with intake ports 338 and 340 together with exhaust ports 342 and 344. One port passes through the surface of each cam segment. Cam 324 also includes an axial hole 346 for receiving shaft 308. The surface of cam 324 is the mirror image of the surface of cam 284 offset by 90°.

The upper surface of each of the four pistons 312–318 has a helicoid face which mates with either of the ascending segments 327 or 332 of the upper cam 324 viewed in respect to arrow 347. Likewise, the helicoid lower face of each of the pistons 312–318 mates with both of the ascending segments 286 and 290 of the lower cam 284.

The pistons 312–318 are set immediately against the shaft 308 and form a seal therewith. The splines **312*f*–318*f* are fitted to engage the slots 283 in housing 282. In this manner the pistons are keyed to the housing so that the pistons may slide axially but are fixed rotatably in respect to the housing. The pistons and housing rotate relative to the fixed cams. The cams 284 and 324 are spaced axially apart so that the pistons 312–318** are positioned therebetween. The cams are simultaneously in contact with the opposing faces of each piston.

The upper and lower intake ports 294, 296, 338 and 340 are located immediately adjacent the upper extensions of the lobes of cams 284 and 324 respectively. The intake ports pass through the cams to provide fluid communication into the rotary transformer 250. The upper and lower exhaust ports 298, 300, 342 and 344 are located adjacent the respective cam surface approximately midway between the lobes within the cam valleys. The exhaust ports provide fluid communication for removing fluids from the rotary transformer 250. The rotary transformer 250 is designed for rotation of the pistons in the direction of arrow 347.

The rotary transformer 250 shown in FIG. 10 functions in basically the same manner as the rotary transformer 80 shown in FIG. 4. The major difference is that in transformer 250 the housing and pistons rotate together as opposed to transformer 80 in which the cental shaft and pistons rotate together.

As described above, the present invention can be embodied as numerous types of pumps and engines, both double-ended and single-ended. The pump and motor configurations can also be combined in a single unit for a specific application. For example, a double-ended embodiment can have an internal combustion engine operating at one end while the opposite end, with possibly differently shaped piston heads, can operate as an air compressor to supply supercharging air to the engine. In a more specific form, the second end can function not only as a supercharger, but by means of a valving arrangement, can function as an exhaust scavenger and secondary burner for reducing the pollution output of the engine. Thus, in normal operation, as in an automobile, the exhaust would be cleaned, but in momentary situations when power is needed, valves could be switched to operate the pump as a supercharger.

As a pressure driven motor, the rotary transformer of the present invention can be operated with multiple pressure stages for greater energy conversion efficiency. For example, the embodiment described in reference to FIG. 4 can be operated as a two-stage engine by having the lower inputs connected in parallel and the lower exhausts connected in parallel to the upper inputs. This embodiment can be operated as a four stage engine by connecting the four inputs and exhausts in series and having overall only one intake and one exhaust. Further, as described above, a transmission arrangement can be produced by various interconnecting combinations of serial and parallel input and output ports.

In each of the embodiments described above the rotary transformer has four pistons operating on a cam surface with four segments. The present invention is, however, not limited to this configuration. In its general form the rotary transformer of the present invention comprises n pistons, where n is any even number, with the pistons operating on a cam surface having n segments. The segments alternate with ascending and descending slopes to form n/2 lobes. The pistons in general are keyed to a central shaft for rotation therewith but are free to reciprocate longitudinally in conformity with the shape of the cam surface, or alternatively the pistons are keyed to the housing.

In the general case of the present invention the cam surfaces are mirror images of each other but one cam is rotationally offset from the other cam by an angle of 360/n degrees.

In the broad form of the invention, the intake ports are located adjacent the peaks of one or more of the lobes of the cam surface. Exhaust ports are located at one or more of the valley points located midway between lobes on the cam surface. The intake and exhaust ports can be located to pass either through the rotary transformer housing or through the cam surface.

Although several embodiments of the invention have been illustrated to the accompanying drawings and described in the foregoing detailed description, it will be understood that the invention is not limited to the embodiments disclosed, but is capable of numerous rearrangements, modifications and substitutions without departing from the scope of the invention.

I claim:

1. A rotary motion transformer, comprising:

a housing;

a shaft extending coaxially within said housing and rotatable relative thereto;

a set of n pistons where n is an even number, each piston having an outer surface mating with the interior surface of said housing and an inner surface mating with said shaft;

an annular cam at one end of said housing, said cam having n helicoid surfaces facing said pistons, said surfaces alternating ascending and descending to form n/2 lobes on said cam;

a helicoid surface on the end of each of said pistons facing said cam, said piston helicoid surfaces mating with alternate ones of said helicoid surfaces on said cam, said pistons rotatable relative to said cam; and port means extending to within said housing for providing fluid communications with said transformer.

2. The rotary motion transformer recited in claim 1 wherein said shaft is provided with a plurality of axial splines and said inner surfaces of said pistons are provided with axial splines wherein said pistons are axially slidable and nonrotatably mated with said shaft.

3. The rotary motion transformer recited in claim 1 wherein said interior surface of said housing is provided with axial splines and said outer surfaces of said pistons are provided with axial splines wherein said pistons are axially slidable and nonrotatably mated with said housing.

4. The rotary motion transformer recited in claim 1 further including means for driving said pistons against said cam.

5. The rotary motion transformer recited in claim 1 wherein said port means comprises a fluid passageway extending through said cam at approximately the peak of each said lobe and at approximately the midpoints between each of said lobes.

6. The rotary motion transformer recited in claim 1 wherein each of the helicoid surfaces of said pistons are recessed along a portion thereof to form a chamber when each one of said pistons is aligned and mated with a corresponding one of said helicoid surfaces of said cam.

7. A rotary motion transformer comprising:

a housing;

a shaft extending coaxially within said housing and rotatable relative thereto;

a set of n pistons where n is an even number, each piston having an outer surface mating with the interior surface of said housing and an inner surface mating with said shaft;

annular cams in each eand of said housing, each cam having n helicoid surfaces facing said pistons, said surfaces alternating ascending and descending to form n/2 lobes on each cam, the surface of one cam being the mirror image of the other cam rotated relative to the other cam by 360/n degrees;

helicoid surfaces on each end of said pistons during said cams, said piston helicoid surfaces mating with alternating ones of said facing helicoid surfaces of said cams, said pistons rotatable relative to said cams and port means extending through said cam to within said housing for providing fluid communication with said transformer.

8. The rotary motion transformer recited in claim 7 wherein said shaft is provided with a plurality of axial splines and said inner surfaces of said pistons are provided with axial splines wherein said pistons are axially slidable and nonrotatably mated with said shaft.

9. The rotary motion transformer recited in claim 7 wherein said interior surface of said housing is provided with axial splines and said outer surfaces of said pistons are provided with axial splines wherein said pistons are axially slidable and nonrotatably mated with said housing.

10. The rotary motion transformer recited in claim 7 wherein said port means comprises a plurality of fluid passageways extending through said cams at approximately the peak of each said lobe and at approximately the midpoints between each of said lobes.

11. The rotary motion transformer recited in claim 7 wherein each of the helicoid surfaces of said pistons are recessed along a portion thereof to form a chamber when each one of said pistons is aligned and mated with a corresponding one of said helicoid surfaces of said cams.

12. A rotary motion transformer comprising:

a housing having a cylindrical interior surface;

a shaft extending coaxially within said housing and rotatable relative thereto, said shaft having axial splines;

a set of four similar pistons, each piston having a one quarter cylindrical outer surface mating with said cylindrical interior surface of said housing each piston having axial splines on the inner surface thereof for mating with said shaft, said pistons axially slidable and nonrotatably mated to said shaft;

an annular cam in one end of said housing, said cam having four helicoid surfaces facing said pistons, said surfaces alternating ascending and descending to form two lobes on said cam;

a helicoid surface on each of said pistons facing said cam, said piston helicoid surfaces mating with alternate ones of said helicoid surfaces on said cam, said pistons rotatable relative to said cam;

first port means comprising fluid communication channels extending through said cam to within said housing in the region of each lobe, the openings of said first port means communication channels located at the surface of said cams adjacent said lobes, and second port means comprising fluid communication channels extending through said cam to within said housing in the midway region between said lobes, the openings of said second port means communication channels at the located surface of said cam adjacent the midpoints between said lobes, said port means providing fluid communication with said transformer.

13. A rotary motion transformer comprising:

a housing having a cylindrical interior surface provided with axial splines;

a shaft extending coaxially within said housing and rotatable relative thereto;

a set of four similar pistons, each piston having one quarter cylindrical outer surface provided with axial splines and mating with said cylindrical interior surface of said housing, each piston having the inner surfaces thereof mating with said shaft, said piston axially slidable and nonrotatably mated to said housing;

an annular cam in one end of said housing, said cam having four helicoid surfaces facing said piston, said surfaces alternating ascending and descending to form two lobes on said cam;

a helicoid surface on each of said pistons facing said cam, said piston helicoid surfaces mating with alternate ones of said helicoid surfaces on said cam said istons rotatable relative to said cam;

first port means comprising fluid communication channels extending through said cam to within said housing in the region of each said lobes, the openings of said first port means communication channels located at the surface of said cams adjacent said lobes; and second port means comprising fluid communication channels extending through said cam to within said housing in the midway region between said lobes, the openings of said second port means communication channels located at the surface of said cam adjacent the midpoints between said lobes, said port means providing fluid communication with said transformer.

14. An internal combustion engine wherein a fuel/air mixture is supplied thereto, comprising in combination:

(a) a housing having a cylindrical interior surface;

(a) a splined shaft extending coaxially within said housing and rotatable relative thereto;

(c) a continuous, annular cam surface coaxial with and fixed relative to said housing, at one end thereof, said cam surface comprising four equal-angular segments each having a helicoid surface, said segments having alternating ascending and descending pitch angles forming two oppositely spaced lobes on said cam surface.

(d) four similar pistons surrounding said shaft and disposed within said housing, said pistons keyed to the splines of said shaft and axially slidable therewith, each of said pistons having a one-quarter cylindrical outer surface mating with said cylindrical interior surface of said housing, each piston having planar, orthogonal leading and trailing surfaces parallel with the axis of said shaft and a helicoid face which faces said cam surfaces and mates with each of said ascending segments of said cam surface, said pistons rotatable relative to said cam surface;

(e) means for biasing said pistons against said cam surface;

(f) input port means adjacent one of said lobes for introducing said fuel/air mixture into a chamber enclosed by the helicoid face of a first of said pistons, the trailing surface of a second of said pistons in a contiguous leading portion to said first piston, said shaft, said cam surface and the interior surface of said housing;

(g) exhaust port means located adjacent said cam surface midway between said lobes for removing gas from said chamber; and (h) means for igniting said fuel/air mixture in said chamber after said mixture has been compressed by a reduction in the volume of said chamber due to relative movement between said pistons and said cam surface.

15. A motor driven by pressurized fluid for producing rotary motion, comprising:

a housing having a cylindrical interior surface;

a shaft extending coaxially within said housing, rotatable relative thereto and provided with longitudinal splines;

a set of n pistons where n is an even number, each piston having an outer surface for mating with the interior surface of said housing and an inner surface having longitudinal splines such that said pistons are axially slidable and nonrotatably mated with said shaft;

an annular cam at one end of said housing, said cam having n helicoid surfaces facing said pistons, said surfaces alternating ascending and descending to form n/2 lobes on said cam;

a helicoid surface on the end of each of said pistons facing said cam, said piston helicoid surfaces mating with alternate ones of said helicoid surfaces on said cam, said pistons rotatable relative to said cam to form a variable volume chamber between each piston and said cam;

an input port means for each of said lobes, each said input port means extending thorough said cam to within said housing and opening at a point offset from the peak of the lobe in the rotational direction of the pistons, said input port means receiving said pressurized fluid which enters an expanding volume one of said chambers and drives said pistons to rotate said shaft; and an exhaust port means for each valley between said lobes, each said exhaust port means extending through said cam to within said housing and opening at a point offset from the midpoint between the lobes in the rotational direction of the pistons, said exhaust port means for releasing said pressurized fluid from a reducing volume one of said chambers.

16. The motor recited in claim 15 further including a spring for each piston for driving said pistons against said cam.

17. An internal combustion engine comprising in combination:

(a) a housing having a cylindrical interior surface;

(b) a shaft extending coaxially within said housing and rotatable relative thereto;

(c) a continuous, annular cam surface coaxial with said shaft and having n equal-angular segments each having a helicoid surface, said segments having alternating ascending and descending pitch angles forming n/2 lobes on said cam surface;

(d) n similar pistons surrounding said shaft, said pistons axially slidable relative to said shaft and said housing, said pistons nonrotatably connected to either said shaft or said housing, each of said pistons having an outer surface mating with said cylindrical interior surface, each of said pistons having an essentially helicoid face with mates with alternate ones of said cam surfaces, said pistons rotatable relative to said cam surface;

(e) means for biasing said pistons against said cam surface;

(f) input port means adjacent at least on of said lobes for communication with a variable volume chamber defined by the helicoid face of a first of said pistons, the trailing surface of a second of said pistons in a leading position to said first piston, said shaft, said cam surface and the interior surface of said housing; and (g) exhaust port means located adjacent said cam surface approximately midway between two of said lobes for releasing fluid from said chamber.

18. An internal combustion engine as recited in claim 17 wherein said pistons and said shaft are nonrotatably connected by means of longitudinal splines and slots fabricated integrally with said pistons and shaft.

19. An internal combustion engine as recited in claim 17 wherein n is four, each of said pistons occupies a 90 degree segment about said shaft, said cam surface has two of said lobes, said input port means comprises a passageway open at the peak of one of said lobes and said exhaust port means comprising a passageway open at the valley point between the two of said lobes.

20. An internal combustion engine as recited in claim 17 including means for igniting a fuel/air mixture which has been received through said input port means and compressed in said chamber.

21. An internal combustion engine as recited in claim 17 including means for injecting fuel into said chamber for ignition therein after air received through said input port means have been compressed in said chamber.

* * * * *

UNITED STATES PATENT AND TRADEMARK OFFICE

CERTIFICATE OF CORRECTION

PATENT NO. : 4,418,656

DATED : December 6, 1983

INVENTOR(S) : Austin N. Stanton

It is certified that error appears in the above-identified patent and that said Letters Patent is hereby corrected as shown below:

Col. 3, line 43, after "Piston" insert "48".

Col. 5, line 14-15, "heiivoid" should be --helivoid--.

Col. 9, line 64, "such, as" should be --such as,--.

Col. 10, line 6, "illustration" should be --illustrative--.

Col. 10, line 27, "rotatably" should be --rotatable--.

Col. 10, line 30, "quided" should be --guided--.

Col. 12, line 7, "238" should be --283--.

Col. 12, line 13, "internating" should be --alternating--.

Col. 12, line 23, "327" should be --328--.

Col. 13, line 45, "to the" should be --in the--.

Col. 14, line 36, "eand" should be --end--.

Col. 14, line 42, "during" should be --facing--.

Col. 15, line 26, after "each" insert --said--.

Col. 15, line 34, after "located" insert --at the--.

UNITED STATES PATENT AND TRADEMARK OFFICE

CERTIFICATE OF CORRECTION

PATENT NO. : 4,418,656

DATED : December 6, 1983

INVENTOR(S) : Austin N. Stanton

It is certified that error appears in the above-identified patent and that said Letters Patent is hereby corrected as shown below:

Col. 15, line 43, before "one" insert --a--.

Col. 15, line 57, "istons" should be --pistons--.

Col. 18, line 5, "on of" should be --one of--.

Col. 18, line 33, "have" should be --has--.

Signed and Sealed this

*Tenth* Day of *July 1984*

[SEAL]

*Attest:*

GERALD J. MOSSINGHOFF

*Attesting Officer*

*Commissioner of Patents and Trademarks*